US005474966A

United States Patent [19]

Asazuma et al.

[11] Patent Number: 5,474,966

[45] Date of Patent: Dec. 12, 1995

[54] THERMAL RECORDING MATERIAL

[75] Inventors: Harumitsu Asazuma; Hiroshi Koyama, both of Ibaraki, Japan

[73] Assignee: Oji Yuka Goseishi Co., Ltd., Tokyo, Japan

[21] Appl. No.: 268,453

[22] Filed: Jun. 30, 1994

[30] Foreign Application Priority Data

Jun. 30, 1993 [JP] Japan ..... 5-183549

[51] Int. Cl.[6] ..... B41M 5/035; B41M 5/38

[52] U.S. Cl. ..... 503/200; 503/207; 503/226

[58] Field of Search ..... 427/150, 151, 427/152; 428/323, 330, 480, 516, 910; 503/200, 207, 226

[56] References Cited

U.S. PATENT DOCUMENTS

| | | | |
|---|---|---|---|
| 5,108,834 | 4/1992 | Asazuma | 428/323 |
| 5,122,413 | 6/1992 | Ohno et al. | 428/319.9 |

FOREIGN PATENT DOCUMENTS

| | | | |
|---|---|---|---|
| 0439049 | 7/1991 | European Pat. Off. | 503/227 |
| 0476508 | 3/1992 | European Pat. Off. | 503/200 |
| 0522740 | 1/1993 | European Pat. Off. | 503/227 |
| 0540020 | 5/1993 | European Pat. Off. | 503/227 |

*Primary Examiner*—B. Hamilton Hess

*Attorney, Agent, or Firm*—Sughrue, Mion, Zinn, Macpeak & Seas

[57] ABSTRACT

A thermal recording material comprising (1) a synthetic paper support having on one side thereof (2) a thermal color forming layer, the support comprising (B) a biaxially stretched resin film as a base layer having (A) a uniaxially stretched thermoplastic resin film containing from 1 to 8% by weight calcium carbonate powder as a calcium carbon powder containing layer on one side thereof, and (C) a uniaxially stretched thermoplastic resin film containing from 15 to 55% by weight inorganic fine powder as a back surface layer on the other side thereof, the thermal color forming layer being provided on the calcium carbon powder containing layer (A), in which (i) the support has an opacity of not more than 45% as measured according to JIS P-8138, (ii) the calcium carbon powder containing layer (A) has a Bekk's index of from 1,000 to 3,500 seconds and a center-line average roughness (Ra) of not more than 0.5 μm, (iii) the back surface layer (C) has a Bekk's index of from 100 to 900 seconds and a center-line average roughness (Ra) of from 0.6 to 1 μm, and (iv) the support has a density of from 0.91 to 1.1 g/cm$^3$ as measured according to JIS P-8118. The thermal recording material has improved image definition, including dot reproducibility, is suitable for diazo copying and high-speed printing, and can be written on with a pencil.

7 Claims, No Drawings

THERMAL RECORDING MATERIAL

FIELD OF THE INVENTION

This invention relates to a thermal (heat-sensitive) recording material for drafting.

BACKGROUND OF THE INVENTION

A high speed (10 to 25 mm/sec) thermal recording apparatus, which provides high definition images equal to those obtained by electrostatic plotters according to a CAD/CAM system, has been developed for use in place of an electrostatic plotter. This thermal recording apparatus is now sold at about half the price of electrostatic plotters.

Advantages of such a raster system thermal recording apparatus are that the same drawing can be continuously output by using a repeat function, which avoids the need to take diazo copies, and an opaque thermal recording material can be used. A thermal recording material conventionally used in this type of recording apparatus is usually prepared by first calendering natural pulp paper having a Bekk's index of not more than 120 seconds to smooth the surface to a Bekk's index of from 150 to 1,100 seconds, providing a thermal (heat-sensitive) recording layer thereon, followed by drying, and then further calendering the thermal recording layer. In order to improve the ability to preserve originals and print at high speed, the use of opaque synthetic paper having an opacity of from 90 to 95% has been suggested. Such paper is known to be useful as a support for a thermal transfer image-receiving sheet as described in JP-A-63-222891, JP-A-63-290790, JP-A-63-307988 and JP-A-63-315293 (the term "JP-A" as used herein means an "unexamined published Japanese patent application").

A thermal recording material, comprising the above-mentioned opaque synthetic paper as a support, has a high Bekk's index (600 to 2500 seconds; measured according to JIS P-8119), excellent high-speed printability, and record preservability. However, such a material is too smooth to allow for satisfactory pencil writing or erasure. There has been a need to improve these properties. There has also been a need to develop a semi-transparent thermal recording material capable of being copied onto diazo-type paper, like the recording material for a CAD electrostatic plotter.

The present inventors previously proposed a semi-transparent thermal recording material capable of being copied in a diazo process, which comprises a synthetic paper support having thereon a thermal color forming layer (see JP-A-3-190787). This support comprises a biaxially stretched resin film base layer, having on both sides thereof a uniaxially stretched thermoplastic resin film containing 10 to 50% by weight calcium carbonate powder as a calcium carbonate powder containing layer. This support has (i) an opacity of not more than 45%, as measured according to JIS P-8138, (ii) a calcium carbonate powder containing layer, on which the thermal color forming layer is formed, that has a Bekk's index of from 100 to 300 seconds and a center-line average roughness (Ra; measured according to JIS B-0601) of not more than 1.5 μm, and (iii) a density of not more than 1.1 g/cm$^3$, as measured according to JIS P-8118. This previously proposed recording material has already put to practical use.

The above-mentioned thermal recording material is suitable for high-speed printing, capable of being copied in a diazo process, and can be written on with a pencil.

However, this material sometimes causes image defects called white spots. In addition, there is still a need for a semi-transparent thermal recording material with improved dot reproducibility.

SUMMARY OF THE INVENTION

The present inventors have found that a support comprising a uniaxially stretched film having reduced calcium carbonate content as a calcium carbonate powder containing layer on which a thermal color forming layer is formed and a uniaxially stretched film having an increased content of an inorganic fine powder as a back surface layer provides a thermal recording material which is capable of being copied in a diazo process, has excellent high-speed printability and image quality, and can be written on with a pencil.

The present invention provides a thermal recording material comprising (1) a synthetic paper support having on one side thereof (2) a thermal color forming layer, the support comprising (B) a biaxially stretched resin film as a base layer having (A) a uniaxially stretched thermoplastic resin film containing from 1 to 8% by weight calcium carbonate powder as a calcium carbonate powder containing layer on one side thereof and (C) a uniaxially stretched thermoplastic resin film containing from 15 to 55% by weight inorganic fine powder as a back surface layer on the other side thereof, the thermal color forming layer being provided on the calcium carbonate powder containing layer (A), in which (i) the support has an opacity of not more than 45% as measured according to JIS P-8138, (ii) the calcium carbonate powder containing layer (A) on which the thermal color forming layer is to be provided has a Bekk's index of from 1,000 to 3,500 seconds and a center-line average roughness (Ra) of not more than 0.5 μm, (iii) the back surface layer (C) has a Bekk's index of from 100 to 900 seconds and a center-line average roughness (Ra) of from 0.6 to 1 μm, and (iv) the support has a density of from 0.91 to 1.1 g/cm$^3$ as measured according to JIS P-8118.

DETAILED DESCRIPTION OF THE INVENTION

The support which can be used in the present invention, on which a thermal layer-forming coating composition is to be applied, is a synthetic, multi-layered tracing paper (opacity: 5 to 45%). The support of the present invention can be prepared as follows. A thermoplastic resin containing from 0 to 3% by weight, and preferably from 1.5 to 3% by weight inorganic fine powder is melt-kneaded in an extruder and extruded from a die into a sheet. After cooling, the extruded sheet is again heated, this time to a temperature lower than the melting point (peak temperature measured with differential scanning calorimeter (DSC)) of the thermoplastic resin by 8° to 15° C. and stretched 3.5 to 8 times in the machine direction at a stretching speed of from 5 to 25 m/min by making use of a difference in peripheral speed among plural rolls.

A thermoplastic resin containing from 1 to 8% by weight calcium carbonate powder, preferably having a particle size of not greater than 1.5 μm, is melt-kneaded in an extruder, extruded from a die into a sheet, and melt-laminated on one side of the above-prepared stretched film.

A thermoplastic resin containing from 15 to 55% by weight, and preferably from 18 to 45% by weight inorganic fine powder, preferably having a particle size of not greater than 1.5 μm, is melt-kneaded in an extruder, extruded from a die into a sheet, and melt-laminated on the other side of the above-prepared stretched film.

The resulting three-layered laminate film is cooled to a temperature lower than the melting point of the thermoplastic resin, re-heated to a temperature in the vicinity of the melting point of the thermoplastic resin (ranging from a temperature lower than the melting point by 3° C. up to a temperature higher than the melting point by 5° C.), and then stretched 4 to 10 times in the transverse direction at a stretching speed of from 17.5 to 200 m/min by means of a tenter. The resulting stretched film was annealed at a temperature higher than the transverse stretching temperature by 2° to 3° C., and then trimmed.

Bekk's index (according to JIS P-8119) and center-line average roughness (Ra) (according to JIS B-0601) are both measures indicative of the degree of surface smoothness. However, they differ in method of measurement, i.e., the former is macroscopically measured while the latter is microscopically measured, so there is no proportional correlation between them. In this regard, reference is made to JP-B-1-35751 (the term "JP-B" as used herein means an "examined published Japanese patent application") and *Reports of Institute of Printing Bureau, Ministry of Finance,* Vol. 29, No. 9, pp. 615–622, "KOGAKUTEKI SESSHOKUHO O CHUSHIN TOSHITA KAMI NO INSATSU HEIKATSUDO NO SOKUTEIHO" written by Shinpei Inamoto (Sep., 1977).

In the present invention, the need for semi-transparency, which is required for a diazo process, is met by selecting trace-type, synthetic paper having an opacity of not more than 45%, and preferably from 5 to 28%. The needs for high-speed printability and high definition image are met by the calcium carbonate powder containing layer having a Bekk's index of from 1,000 to 3,500 seconds, and preferably from 1,300 to 3,000 seconds and a center-line average roughness (Ra) of not more than 0.5 μm, and preferably from 0.2 to 0.4 μm. The needs for smooth paper feed and non-sticking are satisfied by the back surface layer having a Bekk's index of from 100 to 900 seconds and an Ra of from 0.6 to 1 μm. Further, the high definition image and semi-transparency characteristics are balanced by controlling the density of the support between 0.91 and 1.1 g/cm$^3$.

The support has a thickness of from 40 to 100 μm, and preferably from 55 to 70 μm.

The thermoplastic resin which can be used as a material for the support includes those having a melting point of at least 155° C., such as polypropylene, polyethylene terephthalate, and poly(4-methylpentene-1). The inorganic fine powder which can be incorporated into the back surface layer and, if desired, the base layer, includes calcium carbonate, calcined clay, diatomaceous earth, talc, titanium oxide, barium sulfate, aluminum sulfate and silica. The inorganic fine powder to be used in the calcium carbonate powder containing layer is limited to calcium carbonate. Other inorganic fine powders, such as calcined clay and talc, failed to provide a high definition image.

The coating composition for forming a thermal color forming layer is an aqueous dispersion of a thermal color former. Suitable coating compositions include a polyvinyl alcohol aqueous solution having dispersed therein an electron-donating leuco dye, such as Crystal Violet Lactone, and an electron-accepting compound, such as 2,2-bis(4-hydroxyphenyl)propane, in fine particles of not larger than several microns. For the details of preparing the coating composition, JP-B-45-14039, JP-A-55-93492 and JP-A-55-14281 can be referred to. The dispersed particles in the coating composition usually have a volume average particle size of not greater than 8 μm, and preferably not greater than 4 μm, because a thermal color forming layer is generally applied to a thickness of from 5 to 10 μm.

The coating composition on the calcium carbonate powder containing layer of the support is mostly applied with an air knife coater. After coating, the coated film is dried and calendered so as to have sufficient smoothness to allow high-speed printing. For details of this process, refer to Shigyo Times K.K. (ed.), *JOHOSANGYO YOSHI,* pp. 178–207 (1981).

The following Examples are provided to illustrate specific embodiments of the present invention, and are not to be construed as limiting the scope of the invention. In the Examples, all the parts, percents, and ratios are by weight unless otherwise noted.

EXAMPLE 1

Preparation of Support

A resin composition (B) comprising 1) 97% polypropylene, having a melt index (MI) of 0.8 g/10 min and a DSC peak temperature of 164° C., and 2) 3% calcium carbonate, having a specific surface area of 10000 cm$^2$/g, was kneaded in an extruder set at 270° C., extruded into a sheet, and cooled in a cooling apparatus. The sheet was then heated to 156° C. and 5-fold stretched in the machine direction at a stretching speed of 6 m/min.

A resin composition (A), comprising 1) 97% polypropylene having an MI of 4.0 g/10 min, and 2) 3% calcium carbonate, having a specific surface area of 15000 cm2/g, a residue-on-325 mesh sieve of 8 ppm, a whiteness of 92%, a lightness (L* value) of 92.2, a hue (a* value) of +0.8, and a yellowness (b* value) of +1.5; and a resin composition (C) comprising 1) 75% polypropylene, having an MI of 4.0 g/10 min, 2) 5% high-density polyethylene (hereinafter abbreviated as HDPE), and 3) 20% calcium carbonate, having an average particle size of 1.5 μm, were each melt-kneaded in separate extruders at 220° C., extruded from separate dies into a sheet, and laminated on the front and back surfaces, respectively, of the 5-fold stretched film, followed by cooling to 60° C.

The laminate film was re-heated to 164° C. and stretched 7.5 times transversely by means of a tenter, annealed at 166° C., cooled to 60° C. and then trimmed to obtain a multi-layer stretched film support having a three-layered structure (A/B/C=14/30/14 μm).

The resulting support had an opacity of 14.5% and a density of 0.93 g/cm$^3$. The calcium carbonate powder containing layer A had a Bekk's index of 2,800 seconds, an Ra of 0.23 μm, and a maximum center-line roughness ($R_{max}$) of 3.3 μm. Back surface layer C had a Bekk's index of 640 seconds, an Ra of 0.64 μm, and an $R_{max}$ of 6.8 μm.

Preparation of Coating Composition

Crystal Violet Lactone (20 kg) was dispersed in a 10% aqueous solution of polyvinyl alcohol (degree of saponification: 98%; degree of polymerization: 500) by grinding them in a 300 l-volume ball mill for 24 hours. Separately, 20 kg of 2,2-bis(4-hydroxyphenyl)propane was dispersed in a 10% polyvinyl alcohol aqueous solution by grinding them in a 300 l-volume ball mill for 24 hours. The resulting two dispersions were mixed at a Crystal Violet Lactone to 2,2-bis(4-hydroxyphenyl)propane ratio of 1:5. To a 20 kg aliquot of the mixture was added 5 kg of precipitated calcium carbonate, followed by dispersal sufficiently to prepare a coating composition for a thermal color forming layer with a ball mill.

Preparation of Thermal Recording Material

Calcium carbonate powder containing layer A of the support was coated with the coating composition to a solid weight of 6 g/m$^2$ with an air knife coater, dried in a hot air drier at 50° C., and then calendered to obtain a thermal recording material.

EXAMPLE 2

A 1% aqueous solution of an ethylene urea primer was applied to calcium carbonate powder containing layer A of the support prepared in accordance with the process described in Example 1 to a solid weight of 1 g/m$^2$ and dried to prepare a support having a total thickness of 60 μm and an opacity of 13%. The primer layer which adheres on the calcium carbonate powder containing layer A had a Bekk's index of 2,900 seconds, an Ra of 0.2 μm, and an $R_{max}$ of 3.0 μm. The support as a whole had a density of 0.95 g/cm$^3$. The physical properties of the support are shown in Table 1.

A thermal color forming layer was then formed on the primer of the support in the same manner as in Example 1 to obtain a thermal recording material.

COMPARATIVE EXAMPLE 1

A semi-transparent support was prepared in the same manner as in Example 2, except for replacing calcium carbonate in the calcium carbonate powder containing layer A with calcined clay having a particle size of 1 μm. The physical properties of the support are shown in Table 1.

A thermal color forming layer was formed on the primer of the support in the same manner as in Example 1 to obtain a thermal recording material.

COMPARATIVE EXAMPLE 2

A resin composition (B) comprising 70% polypropylene having an MI of 0.8 g/10 min, 5% HDPE, and 25% calcium carbonate, was kneaded in an extruder set at 270° C., extruded from a die into a sheet, and cooled in a cooling apparatus. The sheet was then heated to 140° C. and 5-fold stretched in the machine direction.

A resin composition (A) comprising a) 45% polypropylene having an MI of 4.0 g/10 min, and b) 55% calcium carbonate having a specific surface area of 15000 cm$^2$/g, and a residue-on-325 mesh sieve of 8 ppm, was melt-kneaded in a extruder, extruded into a sheet, and laminated on each side of the 5-fold stretched film, followed by cooling to 60° C. The laminate film was re-heated to 160° C. and stretched 7.5 times transversely by means of a tenter, annealed at 165° C., cooled to 60° C., and then trimmed to obtain an opaque synthetic paper support having a three-layered structure (thickness measured by an electro microscope: A/B/A=15/30/15 μm). The physical properties of the resulting support are shown in Table 1.

A primer layer and a thermal color forming layer were provided on the one side of layer A of the support in the same manner as in Example 2 and Example 1, respectively, to obtain a thermal recording material.

EXAMPLES 3 AND 4 AND COMPARATIVE EXAMPLES 3 TO 6

Supports for Examples 3 and 4, and Comparative Examples 3, 4, 5, and 6 having the physical properties shown in Table 1 were prepared in the same manner as in Example 2 or Comparative Example 2, respectively, except for changing the compounding ratio of calcium carbonate and polypropylene in the base layer and the calcium carbonate powder containing layer and changing the thickness of the base layer and the calcium carbonate powder containing layer as shown in Table 1.

A primer layer and a thermal color forming layer were provided on the layer A side of the supports in the same manner as in Example 2 and Example 1, respectively to obtain a thermal recording material.

Recording

An image was printed on each of the thermal recording materials prepared in Examples 1 to 4 and Comparative Examples 1 to 6 using a large-scaled thermal plotter "TM 1100" manufactured by Graphtec Corporation (resolving power: 16 dot/mm; recording speed: 25 mm/sec). The 10 images formed were ranked 1 to 10 in the descending order of image quality.

Diazo copies were taken of each recorded material under the same exposure conditions. The clearness of the copy was evaluated and ranked B (good), C (fair) or F (failure).

Separately, a solid image was printed on the thermal recording material. The recording density and dot reproducibility were evaluated and ranked A (excellent), B (good), C (fair) or F (failure).

Further, the sticking was evaluated, and the paper feeding property was evaluated and ranked B (good), C (fair) or F (failure).

The results of the evaluation are shown in Table 2 below.

TABLE 1

| | Ex. 1 | Ex. 2 | Comp. Ex. 1 | Comp. Ex. 2 | Ex. 3 | Ex. 4 | Comp. Ex. 3 | Comp. Ex. 4 | Comp. Ex. 5 | Comp. Ex. 6 |
|---|---|---|---|---|---|---|---|---|---|---|
| calcium carbonate powder containing Layer A: Composition (%): | | | | | | | | | | |
| Polypropylene | 97 | 97 | 97 | 45 | 95 | 93 | 95 | 55 | 40 | 30 |
| HDPE | — | — | — | — | — | — | — | — | — | — |
| Calcium carbonate | 3 | 3 | — | 55 | 5 | 7 | 5 | 45 | 60 | 70 |
| Calcined clay | — | — | 3 | — | — | — | — | — | — | — |
| Bekk's Index (sec) | 2800 | 2900 | 1000 | 400 | 2000 | 1300 | 620 | 220 | 150 | 154 |
| Ra (μm) | 0.23 | 0.21 | 0.55 | 0.67 | 0.26 | 0.28 | 0.30 | 0.70 | 0.80 | 0.76 |
| $R_{max}$ (μm) | 3.3 | 3.0 | 6.0 | 8.0 | 4.4 | 4.9 | 6.0 | 8.0 | 12.8 | 11.3 |
| Back Surface Layer C: Composition (%): | | | | | | | | | | |
| Polypropylene | 75 | 75 | 75 | 45 | 80 | 60 | 95 | 55 | 40 | 30 |
| HDPE | 5 | 5 | 5 | — | — | — | — | — | — | — |
| Calcium carbonate | 20 | 20 | 20 | 55 | 20 | 40 | 5 | 45 | 60 | 70 |
| Bekk's Index (sec) | 640 | 640 | 640 | 400 | 800 | 300 | 620 | 220 | 180 | 150 |

TABLE 1-continued

| | Ex. 1 | Ex. 2 | Comp. Ex. 1 | Comp. Ex. 2 | Ex. 3 | Ex. 4 | Comp. Ex. 3 | Comp. Ex. 4 | Comp. Ex. 5 | Comp. Ex. 6 |
|---|---|---|---|---|---|---|---|---|---|---|
| Ra (μm) | 0.64 | 0.64 | 0.64 | 0.67 | 0.61 | 0.72 | 0.30 | 0.70 | 0.76 | 0.80 |
| $R_{max}$ (μm) | 6.8 | 6.8 | 6.8 | 8.0 | 6.0 | 9.2 | 6.0 | 8.0 | 11.8 | 13.2 |
| MD Stretching Temp. (°C.) | 156 | 156 | 156 | 145 | 156 | 156 | 140 | 158 | 156 | 150 |
| TD Stretching Temp. (°C.) | 164 | 164 | 164 | 157 | 164 | 164 | 152 | 170 | 164 | 160 |
| Opacity of support (%) | 14.5 | 13.0 | 19.0 | 94 | 12.0 | 26 | 20 | 71 | 75 | 85 |
| Density of support (g/cm$^3$) | 0.93 | 0.95 | 0.96 | 0.80 | 0.92 | 1.00 | 0.85 | 1.02 | 1.01 | 1.00 |
| Thickness of support (μm) | 58 | 60 | 60 | 60 | 60 | 60 | 60 | 60 | 60 | 70 |

TABLE 2

| | Ex. 1 | Ex. 2 | Comp. Ex. 1 | Comp. Ex. 2 | Ex. 3 | Ex. 4 | Comp. Ex. 3 | Comp. Ex. 4 | Comp. Ex. 5 | Comp. Ex. 6 |
|---|---|---|---|---|---|---|---|---|---|---|
| Recording Density | C | C | F | B | C | C | F | B | B | B |
| Dot Reproducibility | A | A | F | F | A | A | A | B | F | F |
| Sticking | observed | observed | not observed | not observed | observed | observed | observed | not observed | not observed | not observed |
| Order of Image Quality | 3 | 1 | 10 | 7 | 2 | 4 | 5 | 6 | 8 | 9 |
| Paper Feeding Property | B | B | B | B | B | B | F | B | B | B |
| Clearness of Diazo Processing Copy | B | B | C | F | B | C | C | F | F | F |

As described and demonstrated above, the semi-transparent thermal recording material prepared according to the present invention has good paper feeding properties and is suitable for high-speed printing. In addition, it produces high definition images suitable for practical use.

While the invention has been described in detail and with reference to specific examples thereof, it will be apparent to one skilled in the art that various changes and modifications can be made therein without departing from the spirit and scope thereof.

What is claimed is:

1. A thermal recording material comprising (1) a synthetic paper support having on one side thereof (2) a thermal color forming layer, said support comprising (B) a biaxially stretched resin film as a base layer having (A) a uniaxially stretched thermoplastic resin film containing from 1 to 8% by weight calcium carbonate powder as a calcium carbonate powder containing layer on one side thereof and (C) a uniaxially stretched thermoplastic resin film containing from 15 to 55% by weight inorganic fine powder as a back surface layer on the other side thereof, said thermal color forming layer being provided on said calcium carbonate powder containing layer (A), in which (i) said support has an opacity of not more than 45% as measured according to JIS P-8138, (ii) said calcium carbonate powder containing layer (A) has a Bekk's index of from 1,000 to 3,500 seconds and a center-line average roughness (Ra) of not more than 0.5 μm, (iii) said back surface layer (C) has a Bekk's index of from 100 to 900 seconds and a center-line average roughness (Ra) of from 0.6 to 1 μm, and (iv) said support has a density of from 0.91 to 1.1 g/cm$^3$ as measured according to JIS P-8118.

2. The thermal recording material as in claim 1, wherein said support has a thickness of from 40 to 100 μm.

3. A thermal recording material as in claim 2, wherein said support has a thickness of 55 to 70 μm.

4. The thermal recording material as in claim 1, wherein said thermoplastic resin constituting said calcium carbonate powder containing layer, base layer, and back surface layer is a propylene-based resin.

5. The thermal recording material as in claim 1, wherein said support has an opacity of from 5 to 28%.

6. The thermal recording material as in claim 1, wherein said inorganic fine powder in said back surface layer (C) is calcium carbonate.

7. The thermal recording material as in claim 1, wherein the calcium carbonate powder containing layer (A) has a center-line average roughness (Ra) of not more than 0.4 μm.

* * * * *